United States Patent [19]

Lefebvre et al.

[11] Patent Number: 4,741,811

[45] Date of Patent: May 3, 1988

[54] PROCESS AND APPARATUS FOR ELECTROLYTICALLY DEPOSITING IN A MOVING MODE A CONTINUOUS FILM OF NICKEL ON METAL WIRE FOR ELECTRICAL USE

[75] Inventors: Jacques Lefebvre, Voiron; Philippe Gimenez, Grenoble; Gabriel Colombier, Saint Egreve; Armand Golay, Moirans; Jean S. Safrany, Nancy, all of France

[73] Assignee: Aluminium Pechiney, Paris, France

[21] Appl. No.: 19,666

[22] Filed: Feb. 27, 1987

[30] Foreign Application Priority Data

Jan. 6, 1987 [FR] France ..... 87 00952

[51] Int. Cl.[4] ..... C25D 17/00

[52] U.S. Cl. ..... 204/28

[58] Field of Search ..... 204/28

[56] References Cited

U.S. PATENT DOCUMENTS 4,097,342 6/1978 Cooke ..... 204/28

4,126,522 11/1978 Edlund ..... 204/28

4,492,615 1/1985 Lefebvre ..... 204/28

*Primary Examiner*—T. M. Tufariello

*Attorney, Agent, or Firm*—Dennison, Meserole, Pollack & Scheiner

[57] ABSTRACT

The invention relates to a process and an apparatus for electrolytically depositing, in a moving mode, a continuous film of nickel on metal wire for electrical use. The process comprises using an activation bath and a nickel-plating bath in which the current density is reduced in the upstream portion of the nickel plating bath and/or the downstream portion of the activation bath and the acidity of the nickel-plating bath is so regulated as to develop the nickel in the form of strongly adhering globules of small diameter, which completely cover the wire. The reduction in the above mentioned current density and control in respect of the current density profile along the bath may be achieved by acting on the position of the electrodes in the bath and/or by interposing screens between the electrodes and the wire.

9 Claims, 2 Drawing Sheets

Figure 1:
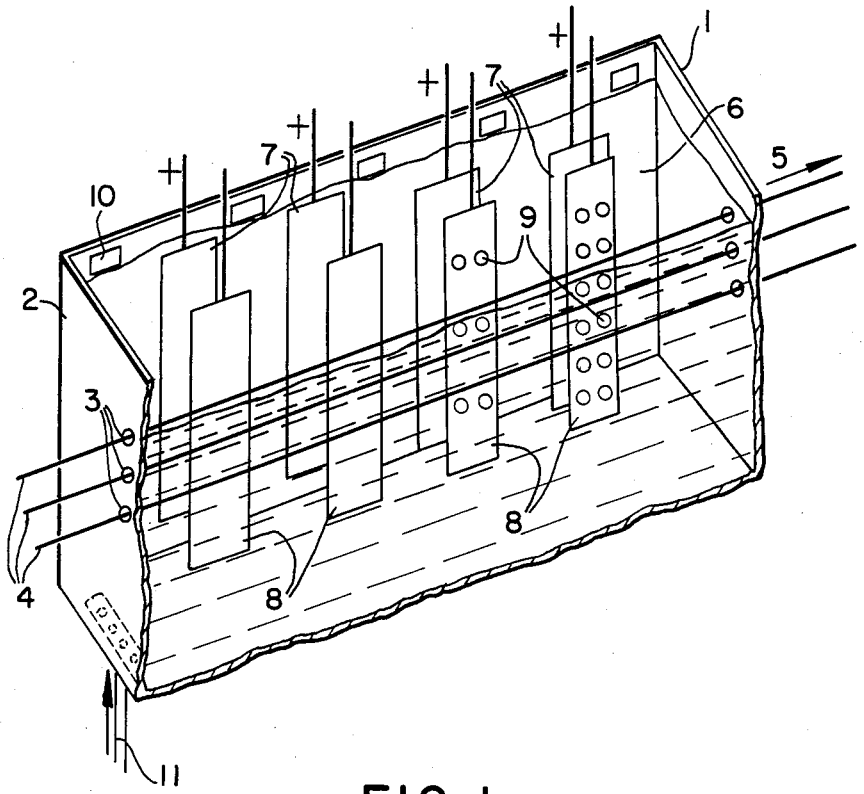

PROCESS AND APPARATUS FOR ELECTROLYTICALLY DEPOSITING IN A MOVING MODE A CONTINUOUS FILM OF NICKEL ON METAL WIRE FOR ELECTRICAL USE

The invention concerns a process and an apparatus for electrically depositing, in a moving mode, a continuous film of nickel in the form of globules of controllable size, on metal wire for electrical use.

U.S. Pat. No. 4,492,615 to the present applicants teaches a process and an apparatus for covering a long length of metal with a metal layer. It is applied in particular to direct nickel plating, that is to say without the application of intermediate layers, on electrical conductors of aluminium or one of the alloys thereof, which are of a diameter of between 1.5 and 3 mm and which are used for either industrial or domestic purposes.

The process comprises passing the wire, after it has first been freed of lubrication residues, through a liquid current supply means which will be referred to hereinafter as an activation bath and in which, by virtue of the flow of a direct or pulsed electrical current, it is positively charged and under the action of acid compounds and/or saline compounds contained in the bath, acquires a surface which is referred to as being active and which is perfectly suitable for a subsequent covering or coating operation; it is then passed through a nickel plating bath wherein, by virture of the same current passing, it is negatively charged and is progressively covered with nickel until a continuous film is formed. That process made it possible to produce on wires moving at close to 300 meters per minute, a film of nickel which is a few microns in thickness and which has in particular a good level of adhesion and a low and non-varying contact resistance, being properties which are essential to provide reliable electrical conductors. The above-mentioned adhesion of the film was such that the wire could then be drawn to a diameter of 0.78 mm without finding any lifting-off or tearing of the nickel covering.

The above-quoted patent also teaches a compact apparatus in which the activation and nickel plating tanks are each close to 5 meters in length and are each provided with a flat or planar electrode which extends parallel to the wire over the whole of its path of movement in the bath.

The applicants now aiming to produce electrical cables from strands formed by a certain number of nickel-plated aluminium wires of a diameter of less than 1 mm, they had envisaged using the above-indicated process by supplementing it with an additional series of wire-drawing operations intended to bring the wires to the required diameter. However they then encountered certain difficulties as regards the performance of the nickel covering which, with substantial reductions in section, suffered from degradation and resulted in a disadvantageous variation in the contact resistance of the wire obtained.

It is for that reason that the applicants tried to apply their process to covering fine wires in order to be able to strand them directly and thus avoid any wire-drawing operation. However, fresh disadvantages were encountered, such as the formation of powdery deposits or discontinuous films.

It is in order to propose a solution to that problem, which solution moreover can be transposed to wires of all dimensions, that the applicants developed according to the invention a process for electrically depositing, in a moving mode, a continuous film of nickel in the form of globules of controllable size, on metal wire for electrical use, wherein, after degreasing, the wire is subjected to a current density which positively charges it by passing it through an activation bath under voltage and then, after rinsing, a current density which charges it negatively by passing it through an acid nickel-plating bath under voltage, and finally a rinsing operation and a drying operation, and which is characterised in that, in order to modulate the current density along the path of movement of the wire, the current density is reduced in the upstream portion of the nickel-plating bath and/or the downstream portion of the activation bath, and the acidity of the nickel-plating bath is regulated to a pH-value of between 1 and 5.

Thus, that process includes the means used in the above-mentioned patent, but added thereto are particular means which make it possible in the nickel-plating bath on the one hand to develop a deposit of nickel in a particular form of globules, adhering perfectly to the wire, thus to avoid any powdery deposit, and on the other hand to control the size and the distribution of said globules in such a way as to provide a continuous covering or coating on the wire. As regards the activation bath, it is found that the above-mentioned particular means has a beneficial effect on preparation of the surface of the wire, in particular by developing fixing centres for the nickel.

The above-mentioned means are formed on the one hand by a reduction in the current density in the upstream portion of the nickel-plating bath or the downstream portion of the activation bath. It was found in fact that, in the prior art where there is a single electrode or even a plurality of electrodes which are distributed in a regular array along the bath and which are parallel to the wire, the current density was very high in the upstream portion of the nickel-plating bath, more particularly, the level of the current desnity increased in proportion to an increasing strength of current introduced, which could be harmful to the quality of the deposit.

The applicants discovered that it was necessary to reduce the current density in the upstream portion of the nickel-plating bath in order to produce a layer of nickel in the form of globules adhering and best covering the substrate and which gives a low level of contact resistance.

That improvement was emphasised by replacing the profile in respect of the current density, which is inherent in the prior process, namely a curve which falls from the entry to the discharge of the bath, by a profile in which a regular rise is followed by a slow fall and in particular by arranging for the maximum density to occur at a location in the bath which is between a third of the length thereof from the entry and the middle, while reducing as much as possible the difference between the maximum density and the minimum density.

Under those conditions, it is observed that there is a reduction in the size of the globules, which results in a higher degree of covering of the wire and consequently a markedly improved level of contact resistance.

The means according to the invention involve on the other hand adjusting the acidity of the nickel-plating bath to a pH-value of between 1 and 5 as the applicants found in that range that it was also possible to reduce the size of the globules of nickel, with the above-indicated advantages, and in particular especially so as the level of acidity increaes. Those results are particularly clearly marked with pH-values of between 2.5 and 3.5.

The acidity of the bath may be increased for example by increasing the amount of sulphamic acid in the nickel-plating bath which, as described in the above-mentioned patent, also contains nickel chloride and orthoboric acid while the activation bath contains the same constituents as described in the above-mentioned patent.

The process according to the invention may be applied to any metal wire such as copper wire for example. However it finds particular attraction in the nickel plating of wires of aluminium or one of the alloys thereof, for electrical use, as, by virtue of its relatively low specific mass and the resulting reduction in weight, it permits a substantial saving of energy when it replaces copper for the production of cables which are intended to be fitted for example to land or air transportation equipment.

The process is particularly suitable for the nickel plating of strands or wires of small section (less than 1 mm) as it gives a strongly adhering covering which makes it suitable for the production of stranded conductors and cables which can be produced by simultaneously nickel-plating a plurality of wires or strands which are disposed in a vertical aligned array in the same bath.

The invention also concerns an apparatus for carrying out the above-described process.

As in the above-mentioned patent, the apparatus comprises, in the direction of movement of the wire, a first tank containing the activation bath, a rinsing compartment, a second tank containing the nickel plating bath, the two tanks each being provided with at least two pairs of flat electrodes, each pair being formed by electrodes disposed on respective sides of the wire or wires and at least partially immersed in their respective baths, the pairs of the activation bath being connected to a negative current source and those of the nickel plating bath being connected to a positive current source. However, it is characterised in that the electrodes of at least one of said pairs are movable and placed at an adjustable distance with respect to at least one adjacent pair and with respect to the wire and that interposed between each of said electrodes and the wire is at least one removable screen of electrically insulating material.

Thus, unlike the prior art, instead of comprising one or more electrodes distributed regularly along the tanks and at an equal distance from the wire, the apparatus according to the invention is formed on the one hand by pairs of electrodes which can be displaced either along the length of the tank to bring them closer together or to move them further apart or the leave free spaces, in particular at one of the ends of the tanks, or along the other dimension of the tank to move them more or less towards the wire or wires to be covered. In that way, it is possible to modulate the current density profile along the wire, having regard to the fact that the absence of electrodes decreases the current density and that the approach movement of the electrodes towards the wire increases it.

In particular the above-defined profile may be attained either by leaving a free space in the upstream portion of the nickel-plating tank and/or the downstream portion of the activation tank, or by moving the electrodes towards the wire in the portion opposite to the above-mentioned portion.

As regards the specific means for displacing the electrodes, they may be produced on the basis of the knowledge of the man skilled in the art.

The apparatus according to the invention also comprises the presence of at least one movable screen between each of the elecrtrodes of at least one pair and the wire. The screens are made of an electrically insulating material and preferably have a good level of resistance to the activation or nickel-plating bath. The screens are placed at a greater or smaller distance from the wire and at least partially mask the electrodes so that they interrupt or divert the lines of current flowing through the baths and therefore make it possible to reduce the current density at precise locations of the bath.

In order to produce the above-described profile, the screens are placed in the upstream portion of the nickel-plating tank, and/or the downstream portion of the activation tank. However, it is possible to produce an even better effect on the above-mentioned profile by using screens which are provided with holes of variable diameters. Preferably, the number of holes is varied in dependence on the position of the screen in the tank and in particular the number of holes is increased in the direction of movement of the wire. It is thus possible to associate solid screens and apertured screens.

The apparatus designed in the above-indicated fashion is suitable for the treatment of one or more wires by providing the walls of the tanks which are disposed in end-to-end relationship with suitable openings which are located beside each other and which are provided with sealing means. Preferably, in order to promote exchanges between the wire and the baths, it is possible to provide for a circulation of the baths by means of pumps. The apparatus is thus auspiciously completed by a rinsing compartment which is intended to eliminate by means of demineralised water any bath which may have been entrained from the nickel-plating tank, the water which wets the wire then being evaporated in a drying compartment.

The assembly of the tanks and the rinsing compartments is designed in the form of modular elements, of lengths and sections which can be adapted to the covering problem involved, and which can be easily associated with each other.

The invention will be better appreciated by reference to FIG. 1 of the accompanying drawing, which shows a perspective view of a nickel-plating tank, in section in the direction of its length along a vertical plane positioned slightly in front of the central plane of symmetry.

Shown in FIG. 1 is the tank 1 of parallelepipedic shape, the small faces 2 of which are each apertured with three holes 3, through which pass three metal wires or strands 4 which move in the nickel-plating bath 6 in the direction indicated by the arrow 5. Shown in the tank 1 are four of the eight electrodes 7 which are positioned vertically on respective sides of the array of wires 4 and which come closer theretowards in the direction in which the wires move through the tank. The electrodes 7 are connected to a positive current source (not shown) while the wires 4 are negatively charged.

Also shown between the electrodes and the array of wires 4 are four of the eight screens 8 which are positioned parallel to the array of wires 4 and at an equal spacing between them, the first two screens 8 in the direction of movement of the wire being solid, while the third screen has six holes 9 therethrough and the last screen has twelve holes.

The electrodes and the screens are suspended in the bath by means (not shown) which permit them to be displaced longitudinally and transversely in the tank. The bath is moved with a circulation movement in an upward direction by means of a pump (not shown) which is supplied by the flow from the overflow means 10 and which pumps that bath into the distribution assembly 11.

Such a representation also applies in regard to the activation tank.

The invention can be illustrated by means of the following Examples of use thereof:

EXAMPLE 1

This Example uses an apparatus which successively comprises:

a first rinsing compartment with inside dimensions of 1000×120×120 mm, containing 9 liters of solution at 70° C., pumped from a reserve tank with a capacity of 80 liters.

a rinsing compartment, an activation tank with inside dimensions of 1000 ×120 ×120 mm, provided with electrodes measuring 100×80 ×80 mm and connected to a negative current source which can supply 2000A at 40 volts and screens measuring 120×40×5 mm of polypropylene which are so disposed as to provide a suitably selected distribution of current density, said tank containing a solution at 45° C. containing 125 g/l of nickel chloride with 6 $H_2O$, 12.5 g/l of orthoboric acid and 6 $cm^3$/l of hydrofluoric acid, circulating upwardly at a rate of 6 $m^3$/h, a second rinsing compartment, nickel-plating tank with inside dimensions of 1000×120×120 mm, fitted with electrodes connected to the positive terminal of the same current source as supplies the activation tank and screens of the same dimensions as those of the activation tank, the assembly being arranged as shown in FIG. 1; the nickel-plating tank contains a solution at 65° C., containing 300 g/l of nickel sulphamate, 30 g/l of nickel chloride and 30 g/l of orthoboric acid, with a pH-value of 3.2 with a circulation in an upward direction at a rate of 6 $m^3$/h, a third rinsing compartment, and a drying oven Using that apparatus, five wires or strands of aluminium of type 1310.50 using the standards of the Aluminium Association, with a diameter of 0.51 mm, were passed simultaneously therethrough, moving at a speed of 50 meters per minute.

Figure 2:
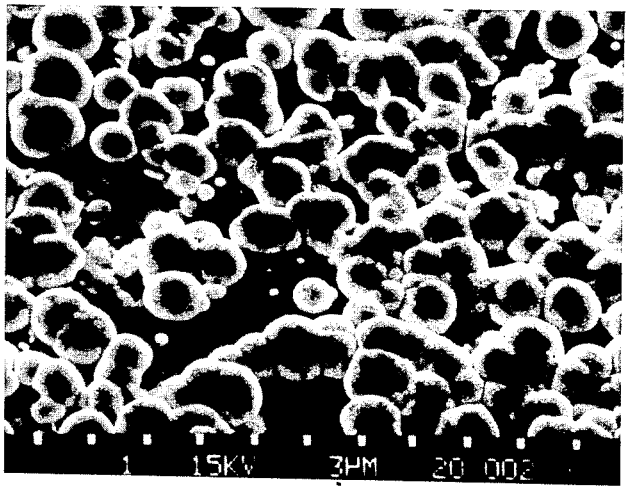
Figure 3:
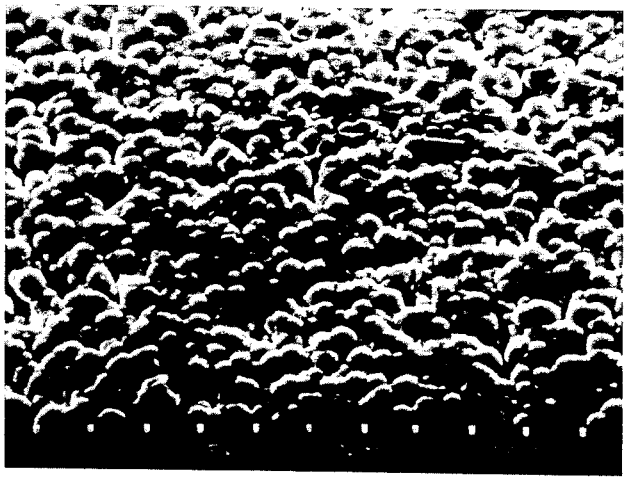

The strands or wires obtained were each covered with a mean thickness of nickel of 1.5 μm in the form of globules of a diameter of 1.0 μm, which are shown enlarged by a factor of 3000 in FIG. 2 and which can be compared to FIG. 3 corresponding to the prior art and which gave much larger globules (3 μm) which do not form a continuous layer.

The wires could be stranded and, in the course of tests in respect of contact resistance, under 500 g, gave values of between 1.5 and 2 mΩ whereas in the prior art in regard to such wires, values of greater than 2 mΩ were obtained.

EXAMPLE 2

The same apparatus was used to treat arrays of five wires of a diameter smaller than that of Example 1, that is to say wires with diameters of 0.32–0.30–0.25–0.20 and 0.15 mm, at speeds of movement of between 25 and 50 meters per mnute, resulting in a deposit of nickel with a mean thickness of 1.0 μm, formed of globules with a diameter of smaller than a micron, with levels of contact resistance of less than one mΩ.

Those nickel-plated wires were stranded and cabled and then insulated with materials approved by the Air Force.

The invention finds application in the nickel plating of metal wires, in particular of aluminium, of any diameter and in particular of diameters of less than 1 mm, and it permits the production by stranding and cabling of light and reliable electrical conductors which are particularly attractive propositions for use in air or land transportion equipment in which energy savings by reducing the weight of the installations used are highly appreciated.

We claim:

1. A process for electrically depositing, in a moving mode, a continuous film of nickel in the form of globules of controllable size, on metal wire for electrical use, wherein, after degreasing, the wire is subjected to a current density which charges it positively by passing it through an activation bath under voltage and then, after rinsing, a current density which charges it negatively by passing it through an acid nickel-plating bath under voltage and finally a rinsing operation and drying operation, characterised in that, in order to modulate the current density along the path of movement of the wire, the current density is reduced in the upstream portion of the nickel-plating bath and/or the downstream portion of the activation bath, and the acidity of the nickel-plating bath is regulated to a pH-value of between 1 and 5.

2. A process according to claim 1 characterised in that the current density is increased and then decreased slowly in the direction of movement of the wire.

3. A process according to claim 2 characterised in that the density is increased so as to have a maximum between the first third and the middle of the bath.

4. A process according to claim 3 characterised in that the difference between the maximum density and the minimum density is reduced, to reduce the size of the globules.

5. A process according to claim 1 characterised in that the acidity of the nickel-plating bath is increased to reduce the size of the globules deposited.

6. A process according to claim 1 characterised in that the acidity is of a value of between 2.5 and 3.5 pH-units.

7. A process according to claim 1 characterised by nickel plating wire of aluminium or one of the alloys thereof, for electrical use.

8. A process according to claim 7 characterised by nickel plating wire of a diameter of less than 1 mm.

9. A process according to claim 8 characterised by nickel plating wire in the form of an aligned vertical array of at least two separated strands which are then stranded together.

* * * * *

UNITED STATES PATENT AND TRADEMARK OFFICE

CERTIFICATE OF CORRECTION

PATENT NO. : 4,741,811

DATED : May 3, 1988

INVENTOR(S) : Jacques Lefebvre et al

It is certified that error appears in the above-identified patent and that said Letters Patent are hereby corrected as shown below:

Figure 2 of the patent should be labeled -- Figure 3 --.

Figure 3 of the patent should be labeled -- Figure 2 --.

Signed and Sealed this

Fourteenth Day of February, 1989

*Attest:*

DONALD J. QUIGG

*Attesting Officer*

*Commissioner of Patents and Trademarks*